US006189409B1

(12) United States Patent
Neag et al.

(10) Patent No.: US 6,189,409 B1
(45) Date of Patent: Feb. 20, 2001

(54) ADJUSTABLE PEDAL SYSTEM

(75) Inventors: Dorinel Neag, Walled Lake; Stylianos A. Meidanis, West Bloomfield; Thomas R. Carbone, Grosse Pointe Park; Victor Johnson, Royal Oak; Joseph E. Rudelic, Canton; Daniel W. Husted, Saline, all of MI (US)

(73) Assignee: DaimlerChrysler Corporation, Auburn, MI (US)

( * ) Notice: Under 35 U.S.C. 154(b), the term of this patent shall be extended for 0 days.

(21) Appl. No.: 09/228,195

(22) Filed: Jan. 11, 1999

(51) Int. Cl.[7] ..... C21C 7/10
(52) U.S. Cl. ..... 74/512
(58) Field of Search ..... 74/512, 513, 542, 74/560, 561, 562

(56) References Cited

U.S. PATENT DOCUMENTS

| | | | |
|---|---|---|---|
| 3,643,524 | 2/1972 | Herring | 74/512 |
| 3,643,525 | 2/1972 | Gibas | 74/512 |
| 3,691,868 | 9/1972 | Smith | 74/512 |
| 4,870,871 | 10/1989 | Ivan | 74/513 |
| 4,875,385 | 10/1989 | Sitrin | 74/512 |
| 4,989,474 | 2/1991 | Cicotte et al. | 74/512 |
| 5,010,782 | 4/1991 | Asano et al. | 74/512 |
| 5,078,024 | 1/1992 | Cicotte et al. | 74/512 |
| 5,351,573 | 10/1994 | Cicotte | 74/512 |
| 5,460,061 | 10/1995 | Redding et al. | 74/512 |
| 5,632,183 | 5/1997 | Rixon et al. | 74/512 |
| 5,676,220 | 10/1997 | Dapsi et al. | 180/334 |
| 5,697,260 | 12/1997 | Rixon et al. | 74/514 |
| 5,722,302 | 3/1998 | Rixon et al. | 74/512 |
| 5,771,752 | 6/1998 | Cicotte | 74/512 |
| 5,884,532 * | 3/1999 | Rixon et al. | 74/512 |

* cited by examiner

*Primary Examiner*—Lenard A. Footland
*Assistant Examiner*—Colby Hansen
(74) *Attorney, Agent, or Firm*—Lawrence J. Shurupoff

(57) ABSTRACT

An adjustable automotive pedal system includes a parallel bar suspension system for a foot pedal assembly system, such that the foot pedal can be adjusted toward the driver seat or away from the driver seat without adversely changing the force-stroke relationship between the foot pedal and the component being controlled by the foot pedal. The pedal system can be used with the vehicle brake, or vehicle clutch, or accelerator linkage.

11 Claims, 2 Drawing Sheets

16
18
3
41
42
2
16
10
31
25
22
30
31
33
3
48
2
25
47
40
42
49
12
30
31
22
31
25
41
25
20
20
39
14
37

41
10
30
42
42
40
40
39

25
10
16
16
27
27
23
23
31

5
5
16
60
62
50
10
70
31
41
30
16
55
59
52
42
57
68
60
31
51
62
71
31
54
56
42
59
30
52
57
41
39
47
31
14
16
66
50
69
68
51
67
37
52

10
60
59
62
18
16
16
50
66
50
31
59
68
52

ADJUSTABLE PEDAL SYSTEM

BACKGROUND OF THE INVENTION

1. Field of the Invention

The present invention relates to adjustable pedal systems, and particularly to pedal systems used in automotive vehicles for controlling such operations as braking, clutch engagement, and vehicle acceleration.

2. Description of the Prior Developments

In many automotive vehicles the foot pedals for controlling the brakes, accelerator and/or clutch have fixed locations. This makes it difficult for a range of differently sized drivers to comfortably reach the pedal. In any given pedal location a tall person may have an uncomfortable cramped sensation, whereas a shorter person may have some difficulty reaching the pedal.

To overcome this problem there have been developed certain adjustable pedal systems. With an adjustable pedal system the pedal is shiftable in a front-to-rear direction so as to be alternately located relatively close to the driver seat or relatively remote from the driver seat, so as to satisfy the ergomatic requirements of a range of differently sized persons. Usually the pedal is shifted toward or away from the driver seat by a servomotor located underneath the dashboard in operative connection with the pedal. The motor is controlled by a manual control on the dashboard.

SUMMARY OF THE INVENTION

The present invention relates to an adjustable pedal system, wherein the relation between the pedal and the vehicle component operated by the pedal remains constant, whatever the adjusted position of the pedal. For example, when the pedal is being used to control the vehicle brakes, the pedal stroke used for applying the full brake force remains the same whatever the adjusted position of the pedal.

In one particular embodiment of the invention the foot pedal assembly is suspended from a parallel bar linkage that includes two swingable parallel links connected to an overhead support and two parallel screws extending between the two links below the overhead support. The parallel screws serve as attachment points for the pedal system.

When the driver applies foot pressure to the pedal, the parallel links swing in unison so as to apply an operating force to the component being controlled, e.g. the brakes, vehicle accelerator linkage, or clutch.

The pedal assembly can be adjusted to different locations, closer or further away from the driver seat, by applying rotational drive forces to the screws. Simultaneous rotation of the parallel screws causes the pedal assembly to be shifted bodily along the screws without disturbing the position or condition of the suspension linkage.

A major feature of the invention is that the pedal assembly can be shifted toward or away from the driver seat without changing, or adversely affecting, the pedal force required to operate the mechanism being controlled by the pedal.

Specific features of the invention will be apparent from the attached drawings and description of illustrative forms of the invention.

DESCRIPTION OF A PREFERRED EMBODIMENT OF THE INVENTION

Figure 1:
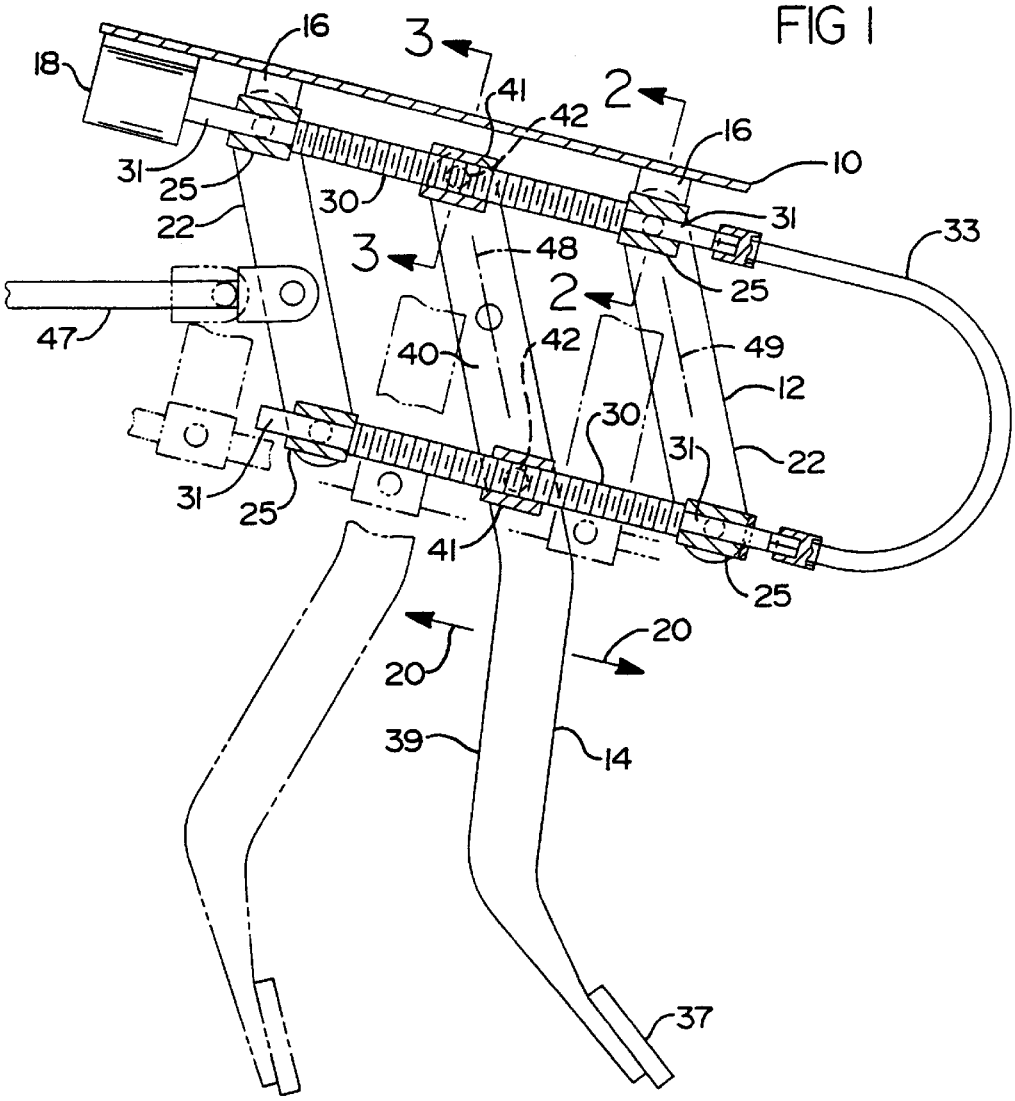
FIG. 1 is a sectional view taken through an adjustable foot pedal system embodying the invention.

FIG. 1 shows an adjustable foot pedal system of the present invention adapted for installation underneath the dashboard of an automotive vehicle, specifically on the driver side of the vehicle in front of the driver seat. The pedal system comprises an overhead support 10 mounted above the vehicle floor, a pedal suspension mechanism 12 swingably attached to the overhead support, and a foot pedal assembly 14 attached to the suspension mechanism.

As shown in FIG. 1, overhead support 10 includes a plate having two sets of ears 16 that serve to pivotably support the suspension mechanism. The forward section of the support plate serves as a mount for a reversible servomotor 18. Motor 18 provides the power for adjusting the pedal assembly 14 in a front-to-rear direction, as denoted by arrows 20 in FIG. 1. In FIG. 1, the front of the vehicle is located to the left of the Fig., and the driver seat is located to the right of the Fig. Pedal assembly 14 is set in an intermediate position, suitable for use by an average size driver. A tall person would adjust the pedal assembly forwardly (leftwardly in FIG. 1), whereas a shorter person might adjust the pedal assembly rearwardly (i.e. rightwardly in FIG. 1).

Figure 2:
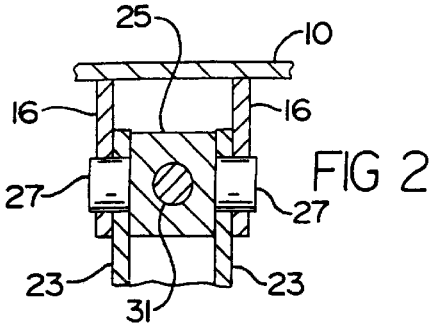
FIG. 2 is a fragmentary sectional view taken on line 2—2 in FIG. 1.

Suspension mechanism 12 includes two parallel links 22 connected to support ears 16. Each link has two parallel straps 23 that extend within ears 16, as shown in FIG. 2. Each end of each link includes a shaft bearing 25 that has stub shafts 27 extending transversely through holes in the associated straps 23, whereby the straps can swing relative to the shaft bearings around the stub shaft axes. The shaft bearing construction depicted in FIG. 2 is duplicated at the three other link ends.

Suspension mechanism 12 further includes two rotary screws 30 extending between the two links 22. Each screw has a shaft 31 extending through one of the shaft bearings 25, whereby each screw can rotate around its axis without disturbing, or affecting, the links 22. During normal application of foot pressure to pedal assembly 14, screws 30 act as non-rotatable parallel bars between links 22. Screws 30 are rotated (by motor 18) when it is desired to adjust the pedal position, as denoted by arrows 20. The rear ends of screws 30 are connected together by a flexible shaft 33, whereby the screws can rotate together (synchronously) when the upper screw is powered by motor 18.

Figure 3:
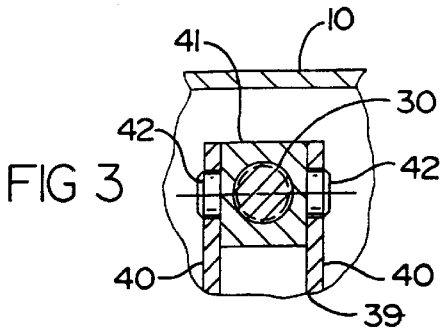
FIG. 3 is a fragmentary sectional view taken on line 3—3 in FIG. 1.

Pedal assembly 14 includes a pedal element 37 and an arm structure 39 extending upwardly across the two parallel screws 30. As indicated in FIGS. 1 and 3, arm structure 39 includes two parallel spaced straps 40 extending alongside the screws 30. Nuts 41 are pivotably connected to the straps by transverse stub shafts 42, whereby each nut can remain in mesh with the associated screw 30 while arm structure 39 is swinging between the full line position and the dashed line position. The nut-shaft arrangement depicted in FIG. 3 is duplicated at the other screw 30.

The pedal suspension mechanism 12 is connected to the component being controlled by means of a push rod 47. As shown in full lines in FIG. 1, the pedal system is in a normal inactive condition wherein the controlled component (e.g. brakes, clutch or accelerator linkage) is unaffected. When foot pressure is applied to pedal element 37 the suspension mechanism 12 swings around the pivot connections on ears 16, toward the dashed line position depicted in FIG. 1. Push rod 47 applies an activating force to the controlled component.

Suspension mechanism 12 forms a parallelogram linkage, wherein parallel screws 30 act as parallel bars between the swingable links 22. The suspension mechanism transfers the operating force from pedal assembly 14 to the push rod 47. While links 22 are swinging around the pivot connections at ears 16, the stub shafts 42 on nuts 41 swivel slightly relative to arm structure 39.

Nuts 41 are located on an imaginary line 48 that is parallel to the swing radius 49 of each link 22. Therefore, when screws 30 are rotated synchronously by servo motor 18 and flexible shaft 33, the nuts move together to maintain the parallel relationship between imaginary lines 48 and 49. Arm structure 39 can thereby be adjusted from the illustrated position, either forward away from the driver seat or rearward toward the driver seat, without adversely affecting the stroke of push rod 47.

An important feature of the invention is that the stroke of push rod 47, for a given depression of pedal element 37, remains the same in any adjusted position of pedal assembly 14 along the parallel screws 30. This enables the pedal system to be used by a short person or a tall person without adversely affecting the operation of the component being controlled (e.g. brakes, clutch or accelerator linkage).

Figures 4, 5, 6:
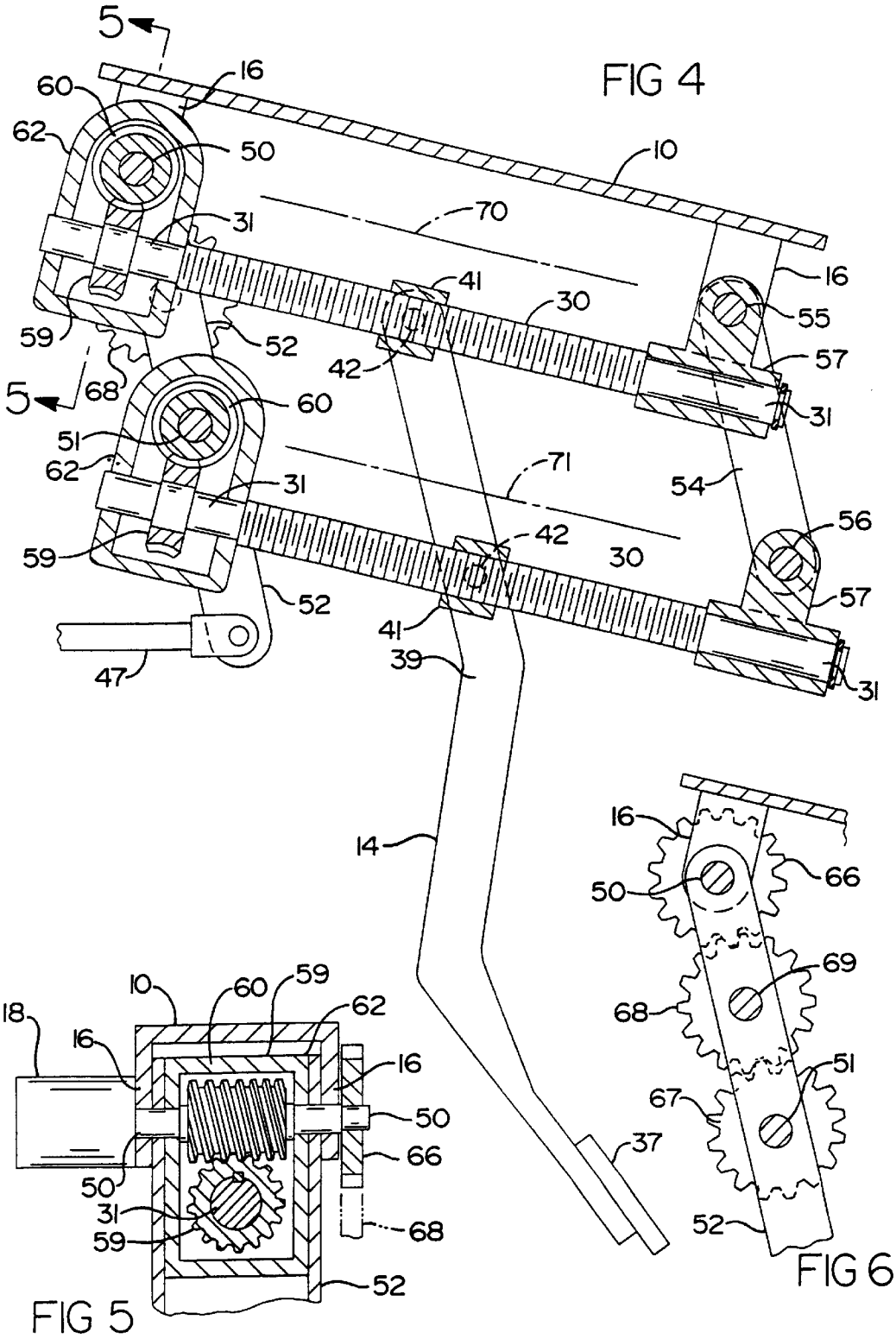
FIG. 4 is a view taken in the same direction as FIG. 1, but showing another form that the invention can take.
FIG. 5 is a sectional view taken on line 5—5 in FIG. 4.
FIG. 6 is a view illustrating a spur gear system used in the FIG. 4 embodiment.

FIGS. 4 through 6 illustrate a second form that the invention can take. The overhead support can be similar in a general sense to the previously described overhead support. However, in this case one set of support ears 16 serves as a mounting for the reversible servomotor 18. Power is supplied by the motor to a transverse shaft 50 that extends transversely through the associated ears 16 at the front end of the overhead support 10.

The parallelogram suspension mechanism includes a front link 52 swingable on shaft 50, and a rear link 54 swingable on a rear shaft 55 that extends between the rearmost ears 16. Each link, 52 or 54, comprises two parallel straps similar to the previously described arrangement.

The two swingable links 52 and 54 are connected together by two parallel screws 30. The rear end of each screw forms a shaft 31 that has a rotatable fit in a shaft bearing 57. Each shaft bearing is swingable on a transverse shaft 55 or 56 extending through the associated link 54.

The front end of each screw 30 forms a shaft 31 that carries a worm wheel 59. Each worm wheel 59 is in mesh with a worm 60 carried on an associated support shaft 50 or 51. Each shaft, 50 or 51, extends through a gear housing 62, whereby the gear housings are supported by the respective shafts 50 or 51. Shaft 50 is supported by the frontmost ears 16. Shaft 51 is supported by the frontmost link 52. Each gear housing 62 provides bearing support for the associated shaft 31 on the respective screw 30. The worm gear drive system shown in FIG. 5 is duplicated for the lower screw 30.

Drive shaft 50 is operatively connected to drive shaft 51 by a helical gear system that includes an upper helical gear 66 carried by shaft 50, a lower spur gear 67 carried by shaft 51, and an intermediate helical gear 68 carried by an idler shaft 69 extending from link 52. FIG. 6 best illustrates the spur gear system. When it is desired to adjust the position of pedal assembly 14 on screws 30, motor 18 (FIG. 5) is energized to supply power to shaft 50; shaft 50 delivers power to the associated worm gear set 60,59. Shaft 50 also delivers power to the associated spur gear system (66,68, 67), whereby shaft 51 is rotated synchronously with shaft 50. During the process of adjusting the position of pedal assembly 14 on screws 30 the two screws rotate together at the same r.p.m., such that arm structure 39 maintains parallelism with links 52 and 54. As in the previous arrangement (FIG. 1 through FIG. 3), arm structure 39 is connected to screws 30 by nuts 41.

The suspension mechanism is a parallelogram bar linkage having four pivot connection points defined by imaginary parallel lines 70 and 71 extending through pivot shafts 50, 55 and 51, 56.

During normal operation of the FIG. 4 pedal system, the action is the same as previously described (i.e. the system of FIG. 1). The suspension mechanism delivers an actuating force from pedal assembly 14 to the push rod 47. When it is desired to adjust the location of pedal assembly 14 along screws 30, motor 18 is energized, such that the screws 30 are rotated synchronously to move the nuts 41 along the screws.

Either form of the invention achieves an important feature of the invention, namely adjustment of the foot pedal toward or away from the driver seat without affecting the relationship between the foot pedal force and the resultant stroke of push rod 47.

What is claimed:

1. An adjustable automotive pedal system, comprising:

a pedal suspension mechanism that comprises an overhead support; first and second parallel links having upper ends thereof directly and swingably attached to said support; and first and second parallel screws extending between said links; and a foot pedal assembly that includes an arm structure spanning said parallel screws in the space between said parallel links; a first nut connecting said arm structure to said first screw, and a second nut connecting said arm structure to said second screw; said screws being rotatable to adjust the position of said arm structure toward either link.

2. The pedal system of claim 1, wherein said screws have the same thread pitch distance.

3. The pedal system of claim 1, wherein each said nut has a rotatable connection with said arm structure.

4. The pedal system of claim 1, wherein each said nut has a pivot shaft connecting the respective nut to said arm structure; each pivot shaft having an axis that intersects the axis of the associated screw.

5. The pedal system of claim 1, and further comprising a power source for simultaneously rotating said first and second screws, whereby the first and second nuts move synchronously along the respective screws.

6. The pedal system of claim 5, wherein said power comprises a motor operatively connected to said first screw, and a flexible shaft connecting said first screw to said second screw.

7. The pedal system of claim 6, wherein said motor is mounted on said overhead support.

8. The pedal system of claim 1, and further comprising a power system for simultaneously rotating said first and second screws; said power source comprising a transverse power shaft extending through said first link in near proximity to each screw, a worm on each power shaft and a worm wheel on the respective screw in mesh with the respective worm.

9. The pedal system of claim 8, wherein said power system further comprises helical gear means on said first link operatively connecting the two power shafts so that said screws rotate synchronously.

10. The pedal system of claim 8, wherein said power system comprises a motor mounted on said overhead support, said motor having a direct drive connection with one of said transverse power shafts.

11. An adjustable automotive pedal system, comprising: a pedal suspension mechanism that comprises an overhead support; first and second parallel links having upper ends thereof directly and swingably attached to said support; and first and second parallel screws extending between said links;

a foot pedal assembly that includes an arm structure spanning said parallel screws in the space between said parallel links; a first nut connecting said arm structure to said first screw, and a second nut connecting said arm structure to said second screw; said screws being synchronously rotatable to adjust the position of said arm structure toward either link;

a push rod output member connected to said first link for reciprocal motion in response to back-and-forth swinging motion of said links;

each said nut having a rotatable connection with said arm structure; and a power means for simultaneously rotating said first and second screws, whereby the first and second nuts move synchronously along the receptive screws.

* * * * *